US005425452A

United States Patent [19]

Shanks et al.

[11] Patent Number: 5,425,452

[45] Date of Patent: Jun. 20, 1995

[54] COMBINATION GOLF AND MISCELLANEOUS CARRYING DEVICE

[76] Inventors: Darrell V. Shanks; Sandra S. Shanks, both of 1806 S. Fairlawn, Evansville, Ind. 47714

[21] Appl. No.: 262,489

[22] Filed: Jun. 20, 1994

[51] Int. Cl.[6] ..... A63B 55/04

[52] U.S. Cl. ..... 206/315.7; 206/315.2

[58] Field of Search ..... 206/315.6, 315.5, 315.7, 206/315.2, 818; 206/818

[56] References Cited

U.S. PATENT DOCUMENTS

| | | | |
|---|---|---|---|
| 1,973,819 | 9/1934 | Link | 206/315.5 |
| 2,970,629 | 2/1961 | Masten | 206/315.2 |
| 3,465,993 | 9/1969 | Muehlhausen | 206/315.7 X |
| 3,866,646 | 2/1975 | Nevard | 206/315.2 X |
| 4,317,477 | 3/1982 | Baptista | 206/315.2 X |
| 4,736,853 | 4/1988 | O'Mara | 206/818 X |
| 5,102,529 | 4/1992 | Hickin | 206/315.5 X |
| 5,314,079 | 5/1994 | Young | 206/315.2 X |

*Primary Examiner*—Stephen P. Garbe
*Assistant Examiner*—Christopher J. McDonald

[57] ABSTRACT

A cylindrical structure comprised of tubes within and without a tube, a tapered shaft complete with shaft end arrow pointed attachment, a tension band at the top of the structure that secures and positions the handle and the tubes, and another tension band that reinforces the tubular structure, aids in securing and positioning the tapered shaft to the structure, surrounds the tubes, and serves as a carrier for miscellaneous items such that golfers, archers and others might find convenient, and a base end closure tube support that connects the tube ends and the lower end of the tapered shaft. The shaft and arrow pointed attachment provides for aeration of the turf over which the golfer, or archer, or other is transversing, as the person pauses and vertically parks the structure by piercing the ground with the tapered shaft end arrow pointed attachment. The invention also serves as a close-in defense mechanism.

3 Claims, 1 Drawing Sheet 14
18
28
12
20A
20
20J
20C
10
16
22
20E
20F
20G
20D
2
2
14
24
12
16

14
16
12
3
3
20
12
14
16

24
16
16A
16B
26
27
16C

COMBINATION GOLF AND MISCELLANEOUS CARRYING DEVICE

BACKGROUND OF THE INVENTION

A patent search was conducted in class 206, subclasses 315.7, 315.5, and 315.3. U.S. Patents uncovered included:

| | | |
|---|---|---|
| 1,973,819 | 09/1934 | Link |
| 2,970,629 | 02/1961 | Masten |
| 3,465,993 | 09/1969 | Muehlhausen |
| 3,866,646 | 02/1975 | Nevard |
| 4,350,194 | 02/1982 | Brown |
| 4,383,563 | 05/1983 | Kirchoff, Jr. |
| 4,449,310 | 05/1984 | Kline |
| 5,050,830 | 09/1991 | Hall |
| 5,102,529 | 04/1992 | Hickin |
| 5,145,140 | 09/1922 | Caston |

Hickin, U.S. Pat. No. 5,102,529, has a spike, detail 42, that is embedded in the bottom wall, 44, of base cap 18, as seen in FIG. 8 (of Hickin's Patent). This is flimsy and structurally inferior to the present invention.

Nevard, U.S. Pat. No. 3,866,646, shows a supporting spine, detail 12 of his FIG. 1. However, it is different in that it is not a rugged shaft as in the present invention. Also, it is held in place by two cotter keys, which seems rather flimsy as opposed to the rivets and three friction bands used in the present invention.

Muehlhausen, U.S. Pat. No. 3,465,993, has a handle separate from the ground piercing tool.

Masten, U.S. Pat. No. 2,970,629, shows a spike inserted in the bottom of his case. Again, as in Hickin, this seems a less rugged approach than as anticipated in the current invention.

None of the above patents have a point shape for more efficient ground penetration and aeration as does the present invention. Furthermore, our invention is rugged enough to double as a defensive weapon.

While the above patents have means of carrying golfing accessories, none of the above inventions have all the features of the present invention in a light weight, well balanced, convenient, and structurally rugged assembly as in our invention.

The present invention provides a light weight, rugged, simple, well-balanced, attractive and convenient means for carrying slender objects plus miscellaneous shapes primarily for, but not restricted to, golfers, archers and surveyors. While the archer, golfer, or surveyor wants to pause to take a shot, or for some other reason, the invention is conveniently parked in an upright position by inserting the tapered shaft with shaft end arrow pointed attachment into the ground. This permits the person to be free of the burden, but to have the contents upright and available as opposed to either having a bag or quiver on his back, or lying on the ground. It is a further object of the invention to provide aeration of the ground the person is traversing. Furthermore, in the case of archers who are bow hunting, the tapered shaft also serves as a last resort defense weapon, or short spear, in the event of a charge by a wounded quarry. This also is a convenience for surveyors using the invention to carry rolled up drawings, as packs of abandoned dogs are an occupational hazard in rural locations. Further objects and advantages of this invention will become apparent from a consideration of the drawing and ensuing description.

SUMMARY OF THE INVENTION

This container for carrying slender objects and also miscellaneous shapes includes a cylindrical housing tube, enclosed at one end, girded by two reinforcing bands plus a third decorative band, partially encompassing a tapered shaft complete with shaft end arrow pointed attachment, containing a number of cylindrical inner tubes and base end tube support closure. Said shaft is both secured within and attached to the above-said base and tube support closure to permit insertion of the aforesaid shaft end arrow pointed attachment into the terrain. The aforesaid shaft and arrow pointed attachment is multi-functional. This is a sturdier invention than previous light weight carriers, as can be seen from the detailed description and drawings. The piercing of the ground by the above-said tapered shaft end arrow pointed attachment and subsequent removal aerates the ground due to the shape of the tapered shaft end arrow pointed attachment. This is desirable, as turf managers go to considerable time, trouble and expense to aerate the soil over which people constantly traverse. The aeration of the soil counters soil compaction and aids grass growth. A further object of the invention, is to permit archers who bow hunt to have a last resort defense mechanism in the event they are charged by wounded quarry or by a pack of abandoned dogs. Such packs frequent many wooded tracts near urban areas. The aforesaid tapered shaft with shaft end arrow pointed attachment doubles as a close-in defense weapon. This is an added feature in the event the invention is used to carry rolled up maps and/or drawings by surveyors. Surveyors and foresters find that packs of abandoned dogs, plus coyotes/dog hybrids are an occupational hazard at times.

The preferred embodiment of the above-said cylindrical housing tube is a woven fabric tube, such as manufactured by hosiery mills, stretched around some or all of the cylindrical inner tubes, holding the inner tubes together, but other embodiments obvious to those skilled in the state of the art would serve the same purpose.

The preferred embodiment of the above-said reinforcing bands is rigid plastic of sufficient tensile strength, but other embodiments obvious to those skilled in the state of the art would serve the same purpose.

The preferred embodiment of the above-said tapered shaft with shaft end arrow pointed attachment is a golf-club driver shank, drilled and tapped on the smaller diameter end to accept a Bear[1] Johnson 145 grain arrow field point which arrow point is then assembled into the tapered shaft end, but other embodiments obvious to those skilled in the state of the art would serve the same purpose. The arrow point has a unique shape as indicated in the drawing description. The preferred embodiment tapered shaft is high carbon steel which is drilled to accept pop rivets as required in securing the tapered shaft shank to the aforementioned second band and also the base end tube closure.

Bear (TM) Archery, Inc., Gainesville, Fla., 32608-4999

The base end tube support closure is a means of securing the housing tube, the inner tubes, and both securing and locating the end of the tapered shaft with shaft end arrow pointed attachment. The decorative plastic band encompassing the above said cylindrical housing tube that contains the base end tube support closure is the preferred embodiment to secure and decorate the above-said cylindrical housing tube to the base and tube support closure, but other embodiments such as appropriate adhesive, or a metal band, or both, obvious to those skilled in the art would serve the same purpose.

A pop rivet securing the tapered shaft to the base end tube enclosure is the preferred embodiment, but other embodiments obvious to those skilled in the state of the art would serve the same purpose.

The first of the aforesaid reinforcing bands is at the top of the cylindrical structure, encompassing the cylindrical housing tube, which contains the inner tubes and secures the assembly of the aforesaid cylindrical housing and inner tubes to each other and also the aforesaid cylindrical housing tube and inner tubes to a tapered shaft handle, which is not contained within the cylindrical housing tube at this juncture. The upper reinforcing band also distances the upper end of the tapered shaft from the tube such that one's fingers can fit comfortably around the shaft. The upper reinforcing band clamps on the upper end of the tapered shaft and around the cylindrical housing tube and tubes contained within and without the cylindrical housing tube. The above-said clamp is formed by the action of the reinforcing band held in place by an appropriate rivet or other such fastener.

The above-said tapered shaft enters the aforesaid cylindrical housing tube at a location approximately ⅓ the distance down the cylindrical housing tube. At the juncture, the tapered shaft passes through the approximately horizontal plain of the second reinforcing band. The second reinforcing band, located at approximately ⅓ the distance down the cylindrical housing tube is multi-functional:

serves as a tension member encompassing the cylindrical structural assembly;

serves as a spacer locating the tapered shaft with respect to the tubes;

serves as a decorative cover of the entry location of the tapered shaft into the cylindrical housing tube; and serves as a accessory belt for carrying items convenient to the golfer, archer, or whomever, including, but not limited to objects such as balls, score card, score boards, pencils, pens, sharpened objects such as golf tees, divot tools and brushes.

In the embodiment shown, the second reinforcing band is designed to hold golf tees, pencil, a golf ball carrier, a score card flippable chart clipboard with magnetic catch, and a divot tool retained by a divot tool retainer spring on the back of the said score card board. A magnetic catch secures the hinged golf score card board in position. A divot tool is mounted on the reverse side of the golf score card board, held in place by a means of a spring clip fastened to the golf score card board. The said golf ball carrier's preferred embodiment is wire form but other embodiments obvious to those skilled in the state of the art would serve the same purpose.

A removable cap is attached to the lower end of the structure with an elastic cord. The cap can be installed on the tip of the shaft end arrow pointed attachment to the tapered shaft when so desired. Other embodiments obvious to those skilled in the state of the art would serve the same purpose.

It is a further object of the invention to use recycled materials, including recycled plastics, golf cub shanks, wire and fabrics. The prototype was built with such materials to prove the practicability.

Figures 1, 2, 3:
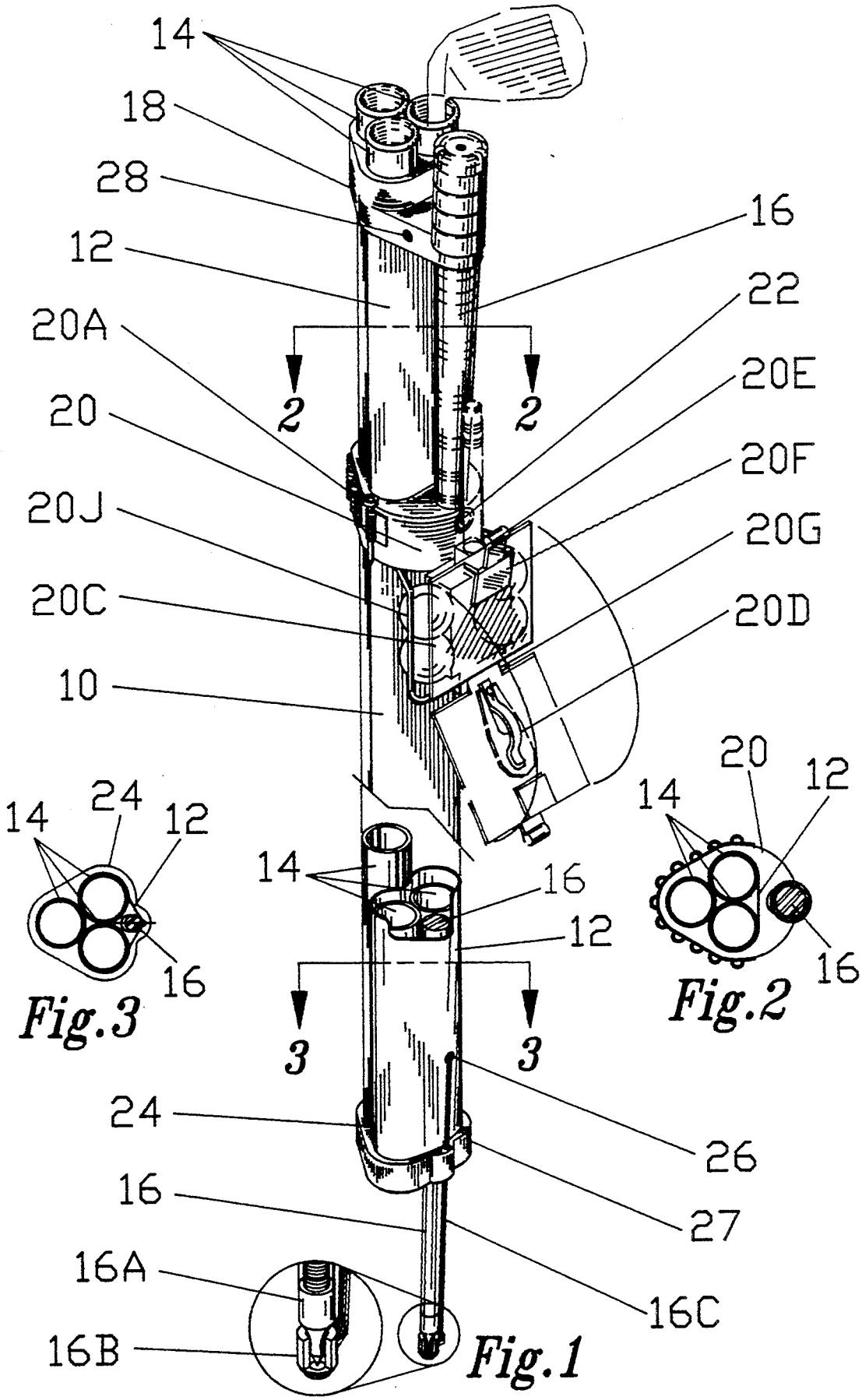
FIG. 1 is a perspective view of the invention
FIG. 2 is a view along line 2—2 of FIG. 1
FIG. 3 is a view along line 3—3 of FIG. 1

DETAILED DESCRIPTION WITH REFERENCE TO DRAWING:

Referring to FIG. 1 illustrates a golf club carrier embodiment of the invention. Tubes (14), are clamped together as a unit by the upper reinforcing band (18), the lower reinforcing band (20), the cylindrical housing tube (12), and the base end tube support closure (24).

The upper reinforcing band (18), the lower reinforcing band (20), and the base end tube support closure (24), position the tapered shaft (16) with respect to the tubes (14) which are contained as a unit within and without the cylindrical housing tube (12), as well as the upper reinforcing band (18), the lower reinforcing band (20), and the base end tube support closure (24).

The tapered shaft (16), in the embodiment illustrated is a golf club shank modified by adding holes for the upper pop rivet (22) and the lower pop rivet (26) and a provision for the insertion of the shaft end arrow pointed attachment (16A). The tapered shaft is secured by the friction clamp action of the upper reinforcing band (18), the upper pop rivet (22), and the lower pop rivet (26). The fastener (28), clamps the upper reinforcing band (18) about the cylindrical housing tube (12) and the tubes (14) which are contained within and without the cylindrical housing tube (12) and the tapered shaft (16). Arrow pointed end cover (16B) is attached to the elastic cord (16C), one end of which said elastic cord (16C) is secured to the tapered shaft (16), through the cylindrical housing tube (12) by means of the lower pop rivet (26). The decorative board (27) encompasses the elastic cord (16C). An alternate embodiment would be to have said elastic cord (16C) held in place by the decorative band (27). However, the preferred embodiment is as shown as it permits the use of a longer elastic cord which permits a given elongation with less unit strain than does the other embodiment mentioned. The lower reinforcement band (20), is multi-functional:

It serves as a carrier for convenient items. In the embodiment shown, the lower reinforcing band (20) is designed to contain golf balls within golf ball carrier (20J) golf tees, pencil, score card and a divot tool. As a part of golf ball carrier (20J) is included a flippable chart clipboard (20C), which includes a divot tool retainer spring (20D), magnetic catch (20E), clip (20F), and hinge It serves as a tension member encompassing the cylindrical housing tube (12), the tubes (14), and the tapered shaft (16);

It serves as a spacer locating the tapered shaft (16) with respect to the tubes (14); and It serves as a decorative cover at the junction where the tapered shaft (16) enters the cylindrical housing tube (12).

The preferred embodiment of ball carrier (26) is wire form, with the said hinge (20G) reinforcing said wire form.

The mid-point of the lower reinforcing band (20) is located approximately ⅓ of the distance from the top of the upper reinforcing band (18). This is important for balance. The base end tube support closure (24) contains the bottom ends of the tubes (14) and also locates the end of the tapered shaft (16) with respect to the ends of said tubes (14). A decorative band (28) serves both as a guard against scuffing and as a decoration in the preferred embodiment.

Although the description contains many specific features, such should not be construed as limiting the scope of the invention but as merely providing illustrations of some of the preferred embodiments of the invention. Thus the scope of the invention should be determined by the appended claims and their legal equivalence, rather than by the examples given.

We claim:

1. A carrier for long slender objects comprising:

a plurality of tubes, a tapered shaft with a shaft end arrow pointed attachment, said tapered shaft being longer than and extending below the plurality of tubes, upper and lower reinforcing bands that encircle the tubes and tapered shaft and position the tubes with respect to the tubes and a base end tube closure that closes the bottom of the tubes, a first fabric tube surrounding the tubes and tapered shaft and extending between the base end tube closure and lower reinforcing band, a second fabric tube surrounding the tubes and extending between the upper and lower reinforcing band, the tapered shaft being outside of the second fabric tube.

2. The carrier of claim 1 wherein:

the reinforcing bands comprise means for holding small articles.

3. The carrier of claim 1 further comprising:

a hinged chart clip board with a retainer spring and magnetic catch connected to the lower reinforcing band.

* * * * *